US006923898B2

(12) United States Patent
Yoshimura et al.

(10) Patent No.: US 6,923,898 B2
(45) Date of Patent: Aug. 2, 2005

(54) ELECTROPLATING DEVICE, AND PROCESS FOR ELECTROPLATING WORK USING THE DEVICE

(75) Inventors: Kohshi Yoshimura, Hyogo (JP); Takeshi Nishiuchi, Osaka (JP); Fumiaki Kikui, Osaka (JP); Masahiro Asano, Kyoto (JP); Takahiro Isozaki, Kyoto (JP)

(73) Assignee: Neomax Co., Ltd., Osaka-fu (JP)

( * ) Notice: Subject to any disclaimer, the term of this patent is extended or adjusted under 35 U.S.C. 154(b) by 360 days.

(21) Appl. No.: 10/028,359

(22) Filed: Dec. 28, 2001

(65) Prior Publication Data

US 2002/0079229 A1 Jun. 27, 2002

Related U.S. Application Data

(62) Division of application No. 09/605,866, filed on Jun. 29, 2000, now Pat. No. 6,348,138.

(30) Foreign Application Priority Data

Jul. 1, 1999 (JP) ..... 11-187325
Jun. 9, 2000 (JP) ..... 2000-174537

(51) Int. Cl.[7] ..... C25D 5/02; C25D 5/00; H01F 7/06

(52) U.S. Cl. ..... 205/145; 205/131; 205/137; 205/143; 29/607

(58) Field of Search ..... 205/131, 137, 205/143, 145; 29/607; 204/202

(56) References Cited

U.S. PATENT DOCUMENTS 1,076,424 A * 10/1913 Held ..... 205/131
3,429,787 A 2/1969 Weinreich et al. ..... 204/26
5,160,421 A 11/1992 Melnyk et al.
5,302,464 A * 4/1994 Nomura et al. ..... 428/551
5,788,820 A 8/1998 Liu
5,902,465 A 5/1999 Pang
6,004,447 A 12/1999 Bischoping et al.

FOREIGN PATENT DOCUMENTS

| | | | | |
|---|---|---|---|---|
| CN | 1029326 C | | 7/1995 | |
| EP | 0 084 752 A1 | | 8/1983 | |
| EP | 1028437 A1 | * | 8/2000 | ..... H01F/7/02 |
| FR | 2148283 | | 3/1973 | |
| JP | 2-97697 A | | 4/1990 | |
| JP | 02097697 A | * | 4/1990 | ..... C25D/7/04 |
| JP | 9-41190 A | | 2/1997 | |
| JP | 09041190 A | * | 2/1997 | ..... C25D/7/04 |
| JP | 10294209 A | * | 11/1998 | ..... H01F/1/08 |
| WO | WO 9923675 A1 | * | 5/1999 | ..... H01F/7/02 |

OTHER PUBLICATIONS

Patent Abstracts of Japan; Publication No. 09–041190, Feb. 10. 1997, (abstract only).
Patent Abstracts of Japan; Publication No. 02–197697; Apr. 10, 1990 (abstract only).

* cited by examiner

*Primary Examiner*—Edna Wong
(74) *Attorney, Agent, or Firm*—Armstrong, Kratz, Quintos, Hanson & Brooks, LLP

(57) ABSTRACT

An electroplating device including an anode inserted through and disposed in a hole provided in a work and communicating with the outside, and a member for rotating the work about its center axis and supplying a plating electric current to the work. Alternatively, a separate member may supply the plating electric current to the work. A plating solution in the hole in the work may be allowed to flow. Thus, a uniform plated film can be formed on both of the outer and inner surfaces of the work having the communicating with the outside such as a ring-shaped work, of which a ring-shaped bonded magnet is representative, by using the electroplating device.

9 Claims, 7 Drawing Sheets

ELECTROPLATING DEVICE, AND PROCESS FOR ELECTROPLATING WORK USING THE DEVICE

This application is a division of prior application Ser. No. 09/605,866, filed Jun. 29, 2000, now U.S. Pat. No. 6,348, 138.

BACKGROUND OF THE INVENTION

1. Field of the Invention

The present invention relates to an electroplating device useful for electroplating a work having a hole communicating with the outside, particularly, a ring-shaped work such as a ring-shaped bonded magnet, and a process for electroplating such a work using the device.

2. Description of the Related Art

A rare earth metal-based permanent magnet such as an R—Fe—B based permanent magnet, of which an Nd—Fe—B based permanent magnet is representative, is used at present in a variety of fields, because it is produced from an inexpensive material rich in natural resources and has a high magnetic characteristic.

In recent years, in electronic and appliance industries where a rare earth metal-based permanent magnet is used, a reduction in size of each of parts has been advanced, and in correspondence to this, it is necessary to reduce the size of the magnet itself and to form the magnet into a complicated shape.

From this viewpoint, public attention is paid to a bonded magnet which is easy to form into a certain shape from a material containing a magnetic powder and a resin binder as main components. Among others, a ring-shaped bonded magnet is utilized, particularly, in various small-sized motors such as a spindle motor, or in a servomotor used in an actuator.

The rare earth metal-based permanent magnet contains a rare earth metal (R) which is liable to be corroded by oxidation in the atmosphere. Therefore, when the magnet is used without being subjected to any surface treatment, the corrosion of the magnet is advanced from the surface due to the presence of a small amount of an acid, an alkali or moisture to produce a rust, and as a result, the deterioration and variability of the magnetic characteristic of the magnet occur. Therefore, a plated film has been conventionally formed as a corrosion-resistant film on a surface of a magnet by subjecting the magnet to an electroplating, but a higher accuracy is required in the formation of the plated film, attendant on the recent demands for the reduction in size of the magnet and for the complication of the shape.

In the case of the ring-shaped bonded magnet, the high dimensional accuracy is required for both of the outer and inner surfaces of the magnet and hence, a uniform plated film must be formed on the outer surface, but also a uniform plated film must be formed particularly on the inner surface. In the case of a ring-shaped bonded magnet having a large L/D value (wherein L represents a length of the magnet in a direction of a center axis, and D represents an inside diameter of the magnet), the following problem is encountered: An area near a central portion of the inner portion of the magnet is lower in current density, resulting in a plated film formed at a smaller thickness. In addition, if air bubbles produced upon the immersion of the ring-shaped bonded magnet into a plating bath and hydrogen gas produced during the electroplating are resident on an inner upper portion of the magnet, they exert a deleterious influence to the formation of a plated film on such portion.

To subject a recessed portion provided in a work to an electroplating, it is a conventional practice that an anode is inserted into and disposed in such portion (for example, see Japanese Patent Application Laid-open No.3-6399). However, when the anode is merely inserted and disposed, the distance between the inner surface of the magnet and the anode cannot be averagely regularized. Therefore, an obtained effect is only that a plated film can be formed efficiently on the inner surface, and the variability of formation of the plated film from portion to portion of the inner surface cannot be overcome.

In addition, if the distance between the outer surface of the magnet and a positive electrode plate is averagely not regularized, the variability of formation of a plated film from portion to portion of the outer surface cannot be overcome.

Further, in electroplating processes proposed hitherto, traces of contact with a plating electric current supplying member and a work fixing member are left on a work and for this reason, a post-treatment is required, which impedes the formation of a uniform plated film.

SUMMARY OF THE INVENTION

Accordingly, it is an object of the present invention to provide an electroplating device and a process for electroplating a work using the device, in which a uniform plated film can be formed not only on the outer surface but also on the inner surface of a work having a hole communicating with the outside, such as a ring-shaped bonded magnet, and the thickness of the plated film can be controlled to any level.

To achieve the above object, according to a first aspect and feature of the present invention, there is provided an electroplating device comprising an anode which is inserted through and disposed in a hole provided in a work and communicating with the outside, and a member for rotating the work about its center axis and supplying a plating electric current to the work.

According to a second aspect and feature of the present invention, there is provided an electroplating device comprising an anode which is inserted through and disposed in a hole provided in a work and communicating with the outside, a member for rotating the work about its center axis, and a member for supplying a plating electric current to the work.

According to a third aspect and feature of the present invention, there is provided an electroplating device comprising an anode which is inserted through and disposed in a hole provided in a work and communicating with the outside, a driving roller made of a metal and adapted to abut against the outer surface of the work to support the work for rotating the work about its center axis and supplying a plating electric current to the work, and a follower roller adapted to abut against the outer surface of the work to support the work.

According to a fourth aspect and feature of the present invention, there is provided an electroplating device comprising an anode which is inserted through and disposed in a hole provided in a work and communicating with the outside, a driving roller adapted to abut against the outer surface of the work to support the work for rotating the work about its center axis, and a follower roller made of a metal and adapted to abut against the outer surface of the work to support the work for supplying a plating electric current to the work.

According to a fifth aspect and feature of the present invention, there is provided an electroplating device comprising an anode which is inserted through and disposed in a hole provided in a work and communicating with the outside, and a means for allowing a plating solution within the hole in the work to flow.

According to a sixth aspect and feature of the present invention, in addition to the first or second feature, the device further includes a means for allowing a plating solution within the hole in the work to flow.

According to a seventh aspect and feature of the present invention, there is provided a process for electroplating a work having a hole communicating with the outside, using an electroplating device according to the first or second feature.

According to an eighth aspect and feature of the present invention, in addition to the seventh feature, the work having the hole communicating with the outside is a ring-shaped work.

According to a ninth aspect and feature of the present invention, in addition to the eighth feature, the ring-shaped work is a ring-shaped bonded magnet.

According to a tenth aspect and feature of the present invention, there is provided a ring-shaped bonded magnet having a plated film on the entire surface thereof, wherein the thickness of the plated film formed on the outer surface is equal to or smaller than that of the plated film formed on the inner surface, and the variability of thickness of the plated film from portion to portion of the outer and inner surfaces is equal to or smaller than 25%.

With the electroplating device according to the present invention, a uniform plated film can be formed on both of the outer and inner surfaces of a work having a hole communicating with the outside, such as a ring-shaped work, of which a ring-shaped bonded magnet is representative.

The above and other objects, features and advantages of the invention will become apparent from the following description of the preferred embodiment taken in conjunction with the accompanying drawings.

DETAILED DESCRIPTION OF THE INVENTION

An electroplating device according to a first embodiment of the present invention will now be described with reference to the accompanying drawings.

An anode 4 is, for example, in the form of a bar circular in section, and is inserted through and disposed in a hole in a hollow work 1, so that the direction of its center axis is parallel to the direction of a center axis of the work 1, and desirably, so that it is located on the center axis of the work 1.

A member for rotating the work about its center axis and supplying a plating electric current to the work is, for example, a driving roller 2-*a* made of a metal. The driving roller 2-*a* is adapted to be rotated by a motor and a belt about its center axis to rotate the work about its center axis, and is also adapted to be connected to a negative pole of a rectifier to supply the plating electric current to the work.

The driving roller 2-*a* maybe brought into abutment against an outer surface of the work 1, or may be brought into abutment against an inner surface of the work 1. Several examples of arrangements will be shown in FIGS. 1*a* to 1*d*.

Figure 1A:
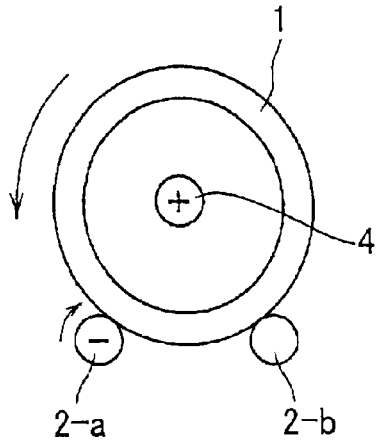
FIGS. 1*a* to 1*d* are illustrations each showing the positional relationship among a work, an anode and a driving roller in an electroplating device according to the present invention.
Figure 1B:
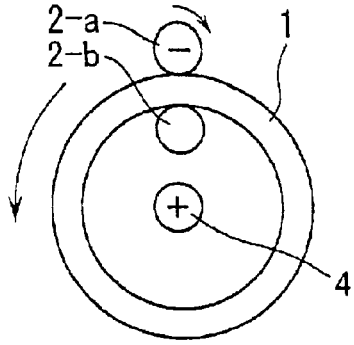
Figure 1C:
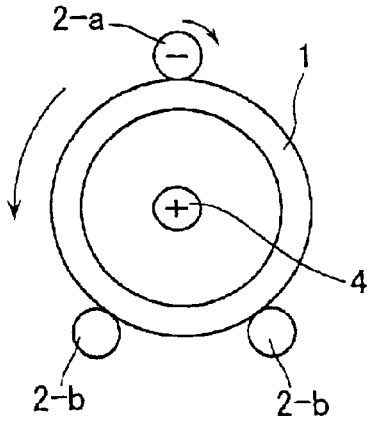
Figure 1D:
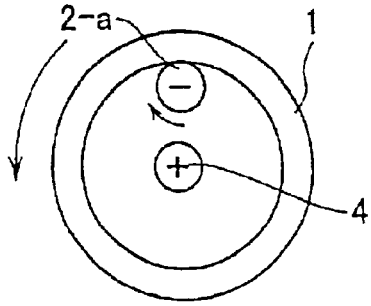

Each of FIGS. 1*a* to 1*d* shows the positional relationship among the work 1, the anode 4 and the driving roller 2-*a* in a view taken from an end face of the work. FIG. 1*a* shows an arrangement in which the work 1 is placed onto and supported on the driving roller 2-*a* and a follower roller 2-*b* disposed in parallel to the driving roller 2-*a* , and the driving roller 2-*a* is rotated as shown in FIG. 1*a* to rotate the work about its center axis, as shown in FIG. 1*a,* and to supply a plating electric current to the work. FIG. 1*b* shows an arrangement in which the driving roller 2-*a* is brought into abutment against the work 1 from the above, thereby clamping the work between the driving roller 2-*a* and the follower roller 2-*b* put into abutment against an upper portion of the inner surface of the work, and the driving roller 2-*a* is rotated, as shown in FIG. 1*b,* thereby rotating the work about its center axis, as shown in FIG. 1*b,* and at the same time, supplying the plating electric current to the work. FIG. 1*c* shows an arrangement in which the work 1 is placed onto and supported on the two follower rollers 2-*b* disposed in parallel to each other, and the driving roller 2-*a* is brought into abutment against the work from the above and rotated as shown in FIG. 1*c,* thereby rotating the work about its center axis, as shown in FIG. 1*c,* and at the same time, supplying the plating electric current to the work. FIG. 1*d* shows an arrangement in which the driving roller 2-*a* is brought into abutment against the upper portion of the inner surface of the work 1 and rotated as shown in FIG. 1*d,* thereby rotating the work about its center axis, as shown in FIG. 1*d,* and at the same time, supplying the plating electric current to the work.

Thus, the plating electric current can be supplied to the work by the driving roller 2-*a* made of the metal to form a plated film on the work 1. In addition, the work is rotated about its center axis, desirably, about the center axis of the anode by a driving force of the driving roller. Therefore, the distance between the inner surface of the work and the anode inserted through and disposed in the hole in the hollow work can be averagely regularized to overcome the variability of formation of the plated film from portion to portion of the inner surface. The distance between the outer surface of the work and the positive electrode plate can be also averagely regularized to overcome the variability of formation of the plated film from portion to portion of the outer surface. Further, since the work is rotated about its center axis by the driving roller, the position of the abutment of the roller against the work is not fixed and thus, no contact trace is left on the work.

An electroplating device according to a second embodiment of the present invention will be described below.

This device has a feature that a member for rotating a work about its center axis and a member for supplying a plating electric current to the work are different members, unlike the device according to the first embodiment.

The member for rotating the work 1 about its center axis is, for example, a driving roller 2-*a* . On the other hand, the member for supplying a plating electric current to the work 1 is, for example, a follower roller 2-*b* made of a metal. Several examples of arrangements will be shown in FIGS. 2*a* to 2*d*.

Figure 2A:
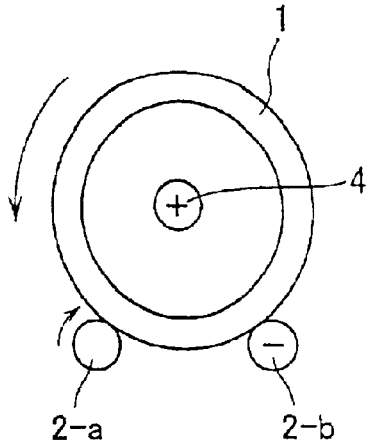
FIGS. 2*a* to 2*d* are illustrations each showing the positional relationship among a work, an anode, a driving roller and a follower roller in another electroplating device according to the present invention.
Figure 2B:
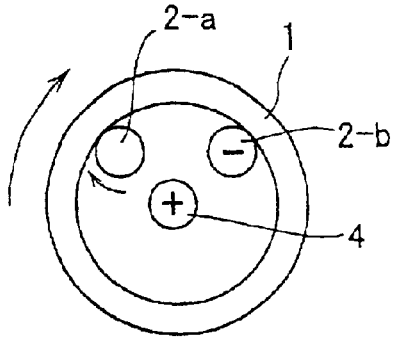
Figure 2C:
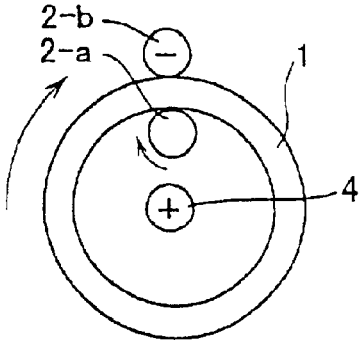
Figure 2D:
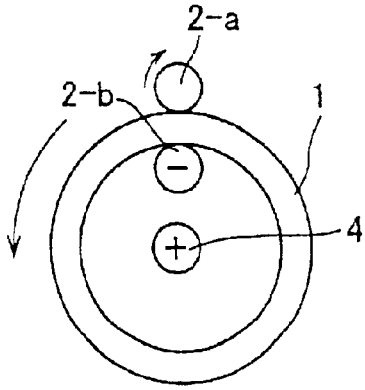

Each of FIGS. 2*a* to 2*d* shows the positional relationship among the work 1, the anode 4, the driving roller 2-*a* and the follower roller 2-*b* in a view taken from an end face of the work. FIG. 2*a* shows an arrangement in which the work 1 is placed onto and supported on the driving roller 2-*a* and the follower roller 2-*b* of the metal disposed in parallel to the driving roller 2-*a* , and is rotated about its center axis, as shown in FIG. 2*a,* by rotating the driving roller 2-*a* as shown in FIG. 2*a,* and a plating electric current is supplied to the work by the follower roller 2-*b* . FIG. 2*b* shows an arrangement in which the driving roller 2-*a* and the follower roller 2-*b* are brought into abutment against an upper portion of an inner surface of the work 1, whereby the driving roller 2-*a* is rotated, as shown in FIG. 2*b,* thereby rotating the work about its center axis, as shown in FIG. 2*b,* and at the same time, the plating electric current is supplied to the work by the follower roller made of the metal. FIG. 2*c* shows an arrangement in which the driving roller 2-*a* is brought into abutment against the upper portion of the inner surface of the work 1, thereby clamping the work between the driving roller 2-*a* and the follower roller 2-*b* of the metal put into abutment against the work from the above, and the work is rotated about its center axis, as shown in FIG. 2*c* by rotating the driving roller 2-*a* , as shown in FIG. 2*c,* and at the same time, the plating electric current is supplied to the work by the follower roller of the metal. FIG. 2*d* shows an arrangement in which the driving roller 2-*a* is brought into abutment against the work 1 from the above, thereby clamping the work between the driving roller 2-*a* and the follower roller 2-*b* of the metal put into abutment against the upper portion of the inner surface of the work, and the work is rotated about its center axis, as shown in FIG. 2*d* by rotating the driving roller 2-*a* , as shown in FIG. 2*d,* and at the same time, the plating electric current is supplied to the work by the follower roller of the metal.

In the second embodiment, the same effect as in the first embodiment is provided.

An electroplating device according to a third embodiment of the present invention corresponds to one of the arrangements of the device according to the first embodiment, which is shown in FIG. 1*a*.

An electroplating device according to a fourth embodiment of the present invention corresponds to one of the arrangements of the device according to the second embodiment, which is shown in FIG. 2*a*.

In the electroplating device according to a fifth embodiment of the present invention, air bubbles produced upon the immersion of a work into a plating bath and hydrogen gas produced during the electroplating can be prevented from being resident on an inner upper portion of a work by a means for allowing a plating solution within a hole in the work to flow. In addition, components such as metal ion and a brightener in the plating solution are supplied neither too much nor too less even into the hole in the work and hence, it is possible to form a uniform plated film on the inner surface of the work.

An electroplating device according to a sixth embodiment of the present invention is similar to the electroplating device according to any of the first and second embodiments, except that it further includes a means for allowing a plating solution within the hole in the work to flow. Thus, according to the sixth embodiment, it is possible to form a further uniform plated film on the inner surface of the work.

According to a seventh embodiment, an eighth embodiment and a ninth embodiment of the present invention, a uniform plated film can be formed not only on an outer surface but also on an inner surface of a hollow work which has a hole communicating with the outside and which is represented by a ring-shaped bonded magnet.

According to a tenth embodiment of the present invention, a ring-shaped bonded magnet is provided, which is suitably utilized to a spindle motor or the like.

It should be noted that the hole provided in the hollow work and communicating with the outside may be made through opposite ends of the work, or may be closed at one of the opposite ends.

A process for electroplating a ring-shaped bonded magnet using the electroplating device having one of the arrangements shown in FIG. 1*a* according to the first embodiment will be described below.

Figure 3:
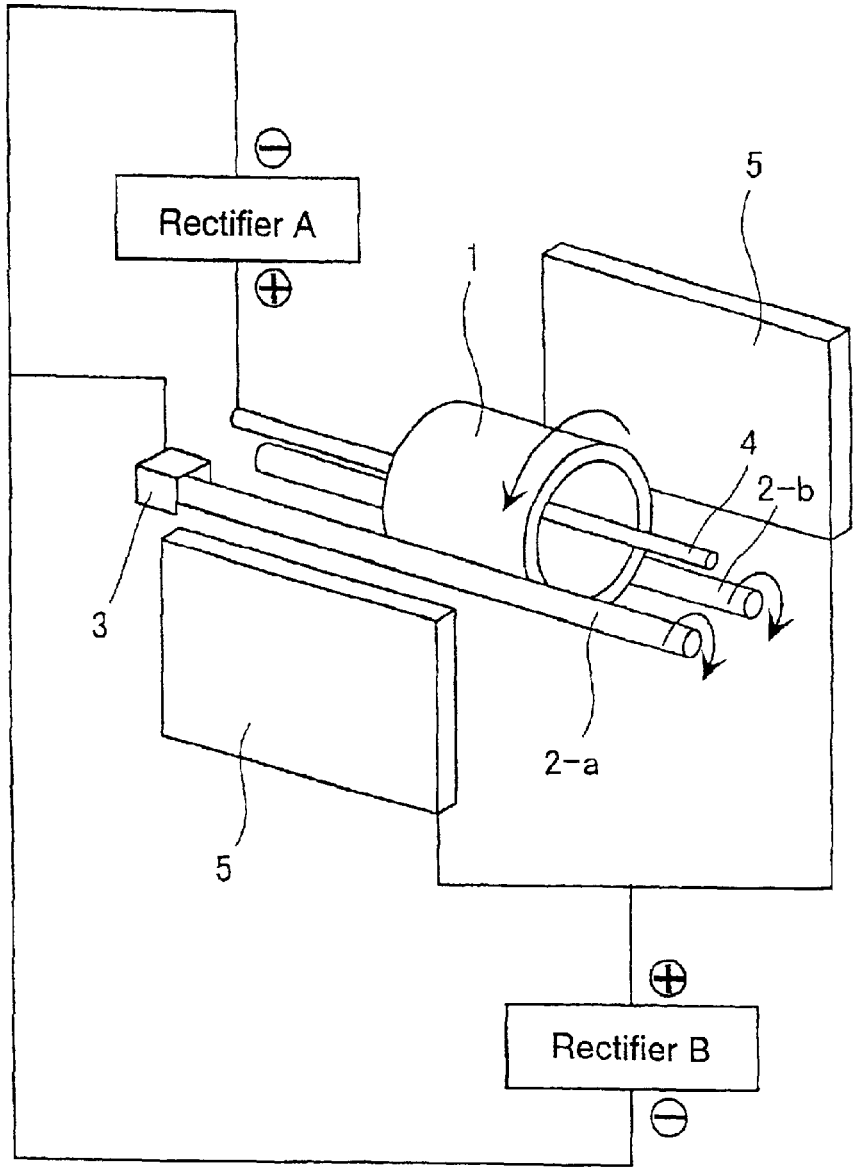
FIG. 3 is a schematic diagram of an apparatus used in an embodiment of an electroplating process using the electroplating device according to the present invention.

FIG. 3 is a schematic diagram of an apparatus used in an embodiment of a process for electroplating a ring-shaped bonded magnet using the electroplating device. The electroplating device includes an anode inserted through and disposed in a hole provided in a work and communicating with the outside, a driving roller made of a metal and adapted to abut against an outer surface of the work to support the work for rotating the work about its center axis and supplying a plating electric current to the work, and a follower roller which is adapted to abut against an outer surface of the work to support the work. A plating solution and a plating bath are not shown in FIG. 3.

The work designated by reference character 1 and having the hole communicating with the outside is a ring-shaped bonded magnet. In this embodiment, the magnet is placed onto and supported on the driving roller 2-*a* made of the metal and the follower roller 2-*b* which are disposed in parallel to each other. The driving roller 2-*a* made of the metal is clamped by a member 3 of a metal having a spring property and connected to negative poles of rectifiers A and B, thereby reliably supplying a plating electric current to the magnet. The follower roller 2-*b* is formed of an insulating material. The anode designated by reference character 4 is in the form of bar circular in section and is disposed through the hole in the magnet, so that the direction of its center axis is parallel to the direction of a center axis of the magnet, desirably, so that it is located on the center axis of the magnet. The anode 4 is connected to a positive pole of a rectifier A. A positive electrode plate denoted by reference character 5 is connected to a positive pole of a rectifier B.

The plated films can be formed on the outer and inner surfaces of the magnet, so that the thickness thereof can be controlled by conducting the supplying of the plating electric currents to the anode 4 and the positive electrode plate 5 using the different rectifiers and by rectifying the currents supplied to the anode and the positive electrode plate. For example, the plated films can be formed on the outer and inner surfaces of the magnet, so that the thickness of the plated film on the outer surface is larger than or equal to that of the plated film on the inner surface, while maintaining uniformity of the thickness of the plated film. Of course, the thickness of the plated film on the outer surface of the magnet can be smaller than that of the plated film on the inner surface of the magnet.

In a case of a spindle motor in which the ring-shaped bonded magnet is utilized, a yoke usually used in the motor of this type for preventing the leakage of a magnetic flux may be disposed outside or inside the magnet depending upon the structure of the spindle motor. If the thickness of a plated film formed on the surface of the magnet on the side of the yoke disposed is larger than that of a plated film formed on the other side, the plated film formed on the side of the yoke functions not only as a mere corrosion-resistant film, but also serves to prevent the leakage of the magnetic flux. Therefore, a rotor having no yoke provided thereon can be produced.

In addition, for example, even if the dimensional accuracy of the ring-shaped bonded magnet is not good, the distance between the magnet and a stator can be adjusted to a small value by controlling the thickness of the plated film on the inner surface of the magnet and hence, the characteristic of the motor can be enhanced. Further, if the thickness of the plated film on the outer surface of the magnet is substantially equal to that of the plated film on the inner surface of the magnet, the strength of the ring-shaped bonded magnet is enhanced remarkably by a mechanically reinforcing effect provided by the plated films.

The control of the thickness of the plated film on each of the outer and inner surfaces of the magnet can be also achieved, for example, by regulating the distance between the magnet and the positive electrode plate. However, according to the above-described process using the different rectifiers, the thickness of the plated film on each of the outer and inner surfaces of the magnet can be controlled easily, for example, even on a mass-production line in which it is difficult to regulate the distance between the magnet and the positive electrode plate.

When the driving roller 2-*a* is rotated about its center axis as shown in FIG. 3 by a motor and a belt which are not shown, the magnet 1 is also rotated about its center axis with the rotation of the driving roller 2-*a* , as shown in FIG. 3, whereby the follower roller 2-*b* is also rotated. The distance between the inner surface of the magnet 1 and the anode 4 inserted through and disposed in the hole in the magnet is averagely regularized by the rotation of the magnet and hence, a plated film can be formed with no variability of thickness from portion to portion of the inner surface of the magnet. In addition, the distance between the outer surface of the magnet 1 and the positive electrode plate 5 is averagely regularized by the rotation of the magnet and hence, a uniform plated film can be also formed on the outer surface of the magnet.

Further, since the magnet 1 and the two rollers 2-*a* and 2-*b* are rotated about their center axes, the positions of the abutment of the magnets against the two rollers 2-*a* and 2-*b* are not fixed. Therefore, no traces of contact with the rollers are left on the outer surface of the magnet and hence, it is unnecessary to treat the contact traces after the electroplating treatment.

The follower roller 2-*b* has been described as being formed of the insulating material in FIG. 3, but may be formed of a metal, as is the driving roller 2-*a* , so that the plating electric current can be supplied to the magnet. The follower roller 2-*b* may be a driving roller. It is desirable that at least the member for supplying the plating electric current to the magnet is rotated, whether it is the driving roller or the follower roller. This is because if such member is not rotated, there is a possibility that the member causes an uneven increase in thickness of the plated film to obstruct the rotation of the magnet, and there is a possibility that the plating electric current cannot be supplied sufficiently to the magnet.

The metal material forming the anode 4 is particularly not limited, but it is desirable that the material is a metal identical to the metal forming the plated film, because an effect of supplement of plated-film forming metal ions in a plating solution is provided, leading to an enhanced plating efficiency. In this case, however, there is a possibility that the thickness of such anode is gradually decreased with the advance of the plating treatment and as a result, the anode cannot fulfill its function, but also fine metal pieces or a metal powder is produced and dropped onto and accumulated on the inner surface of the magnet. If a plated film is formed on such fine metal pieces or metal powder accumulated on the inner surface of the magnet, the plated film portion on the fine metal pieces or the metal powder protrudes to influence the uniformity of the thickness of the entire plated film. Therefore, when the anode is made of a metal material identical to the plated-film forming metal, it is desirable that the anode is placed into a mesh-like net made of an inert metal such as Pt or an insulating material to prevent the dropping of fine metal pieces or a metal powder onto the inner surface of the magnet. Alternatively, a cylindrical net cage made of an inert metal may be used as the anode and, metal chips or pieces as a material for forming a plated film may be placed into the net cage, thereby enhancing the plating efficiency.

Figure 4:
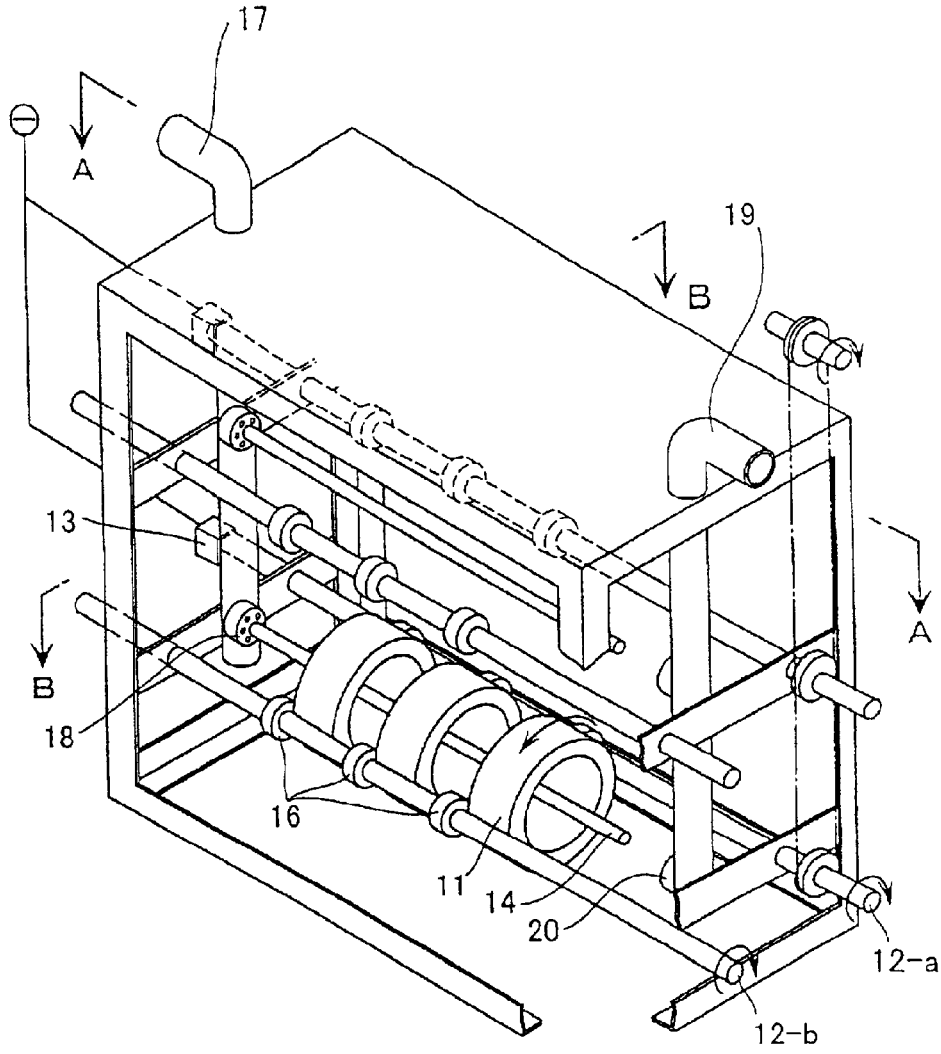
FIG. 4 is a schematic view of an electroplating device according to the present invention, which is capable of treating a plurality of works simultaneously.

FIG. 4 is a schematic view of an electroplating device capable of electroplating six magnets simultaneously in a state in which three magnets have been set at a lower stage. In FIG. 4, the device is shown as being partially perspective and cutaway to facilitate the understanding of the internal situation of the device.

A driving roller 12-*a* is mounted, so that it can be rotated about its center axis through a belt (not shown) by a motor (not shown). The driving roller 12-*a* is made of a metal to be able to supply a plating electric current to the magnets, and is clamped by a member 13 of a metal which has a spring property and which is connected to a negative pole of a rectifier (not shown) to reliably supply the plating electric current to the magnets. Reference character 12-*b* designates a follower roller formed of an insulating material. A bar-shaped anode denoted by reference character 14 is detachably connected to a positive pole of the rectifier by a wire which is not shown. The adjacent magnets are set so that they are spaced at a distance apart from each other by a spacer 16 made of an insulating material. The provision of the spacers 16 ensures that a plated film can be formed satisfactorily even on end faces of each magnet. By setting the magnets so that they are spaced at appropriate distances apart from one another by the spacers, the concentration of an electric flux line on an edge portion of each magnet can be moderated, thereby further enhancing the uniformity of a plated film.

When the driving roller 12-*a* is rotated about its center axis, as shown in FIG. 4, the magnets 11 are also rotated about their center axes with the rotation of the driving roller 12-*a* , as shown in FIG. 4, whereby the follower roller 12-*b* is also rotated. The distance between the inner surface of each of the magnets and the anode 14 inserted through and disposed in the hole in each of the magnets is averagely regularized by the rotation of the magnets and hence, a plated film can be formed with no variability of the thickness from portion to portion of the inner surface of each of the magnets. In addition, the distance between the outer surface of each of the magnets and the positive electrode plate is averagely regularized by the rotation of the magnets and hence, a uniform plated film can be also formed on the outer surface of each of the magnets.

Further, since the magnets 11 and the two rollers 12-*a* and 12-*b* are rotated about their center axes, the positions of the abutment of the magnets against the two rollers 12-*a* and 12-*b* are not fixed. Therefore, no traces of contact with the rollers are left on the outer surfaces of the magnets and hence, it is unnecessary to treat the contact traces after the electroplating treatment.

The electroplating device may include a mechanism capable of regulating the distance between the two rollers 12-*a* and 12-*b* , and a mechanism capable of locating the anode 14 on the center axes of the magnets.

Figure 5:
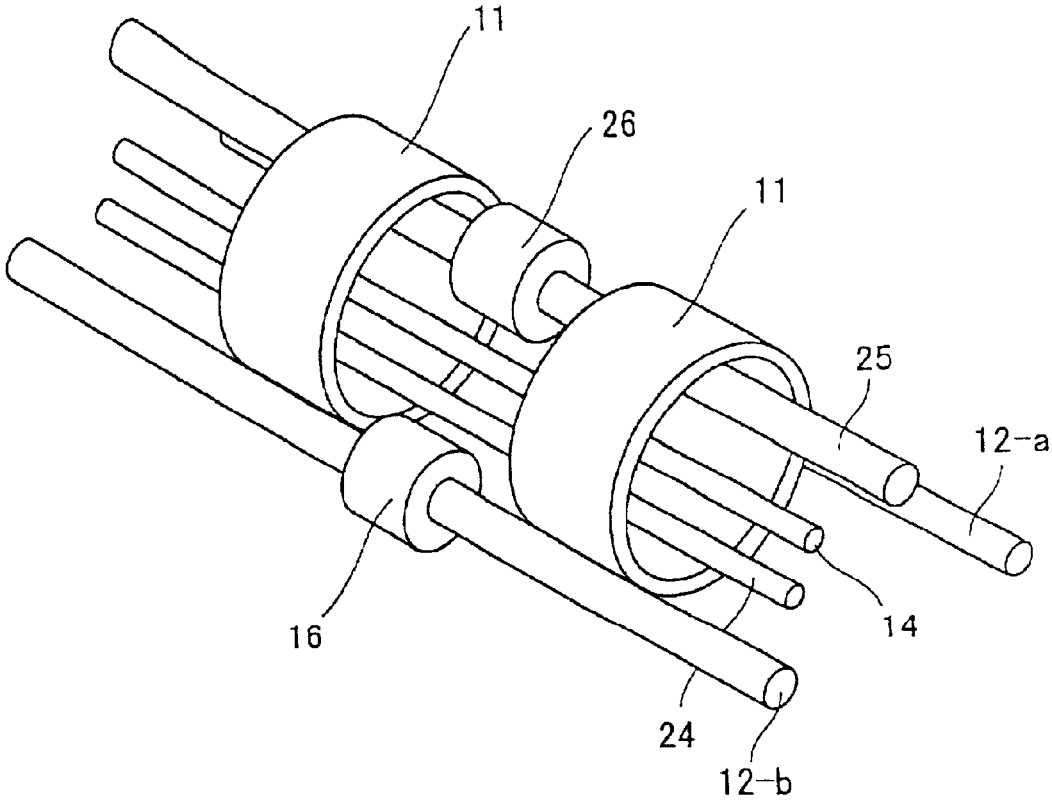
FIG. 5 is a partial enlarged view of the device with works set therein.

To treat a lightweight work 11 such as a ring-shaped bonded magnet, as shown in FIG. 5, a weight member 24 may be mounted to abut against a lower portion of an inner surface of the work 11 in order to reliably supply a plating electric current to the work. In addition, a bar-shaped member 25 having a spacer 26 attached thereto may be inserted through and disposed in the hole in the work in order to quiet the movement of the magnet which is being treated. The bar-shaped member 25 is disposed, so that the weight of the work is not applied thereto. The bar-shaped member 25 is detachably attached to the device. Thus, the following advantage is provided: The work can be set easily by hanging the work by the bar-shaped member 25 and attaching the bar-shaped member to the device, leading to an enhanced operability.

The electroplating device shown in FIG. 4 is provided with a member 17 having a discharge port 18 for a plating solution, and a member 19 having an intake port 20 for the plating solution. Both of the members are connected to a plating solution circulating pump (not shown) by a hose (not shown).

Figure 6:
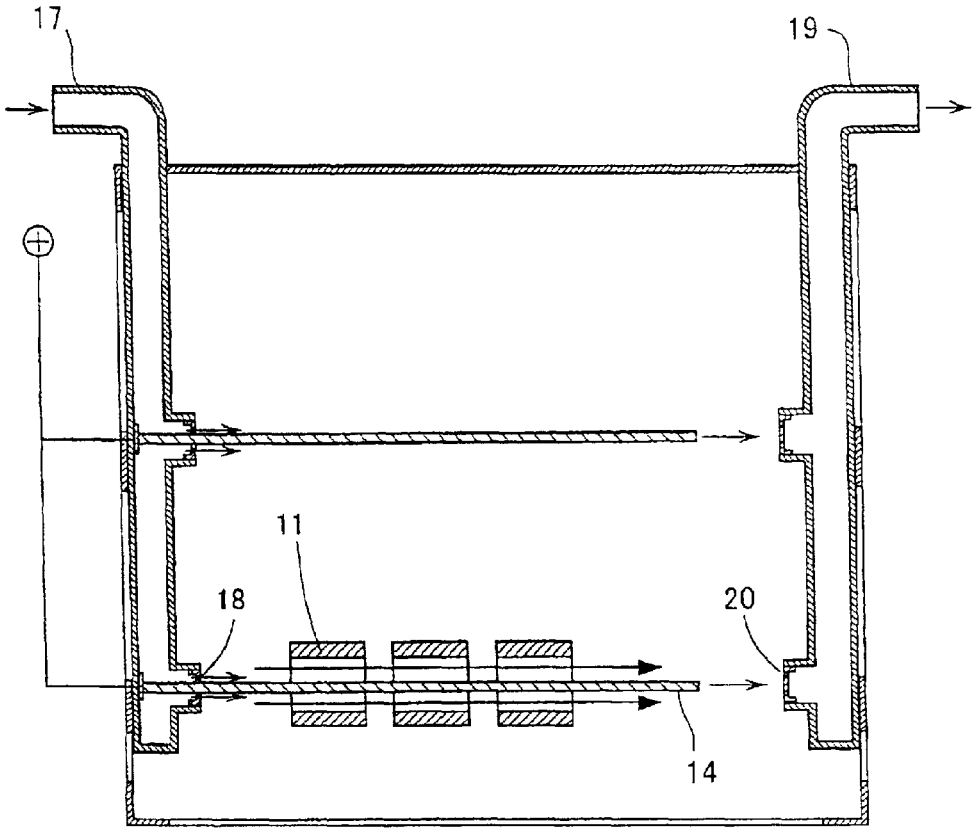
FIG. 6 is a sectional view of the electroplating device, taken along a line A—A in FIG. 4.

FIG. 6 is a sectional view of the electroplating device taken along a line A—A in FIG. 4. As shown in FIG. 6, the plating solution is introduced into the member 17 by the plating solution circulating pump, discharged vigorously through the discharge port 18, passed through the holes in the magnets and drawn through the intake port 20 into the member 19. Thus, the plating solution in the holes in the magnets can be allowed to flow by circulating the plating solution in the above manner. Therefore, airbubbles produced upon the immersion of the magnets into a plating bath and hydrogen gas produced during the electroplating, which may hinder the formation of a plated film on the inner surface of each of the magnets, can be prevented from being resident on the inner upper portion of the magnet. Additionally, components such as metal ions and a brightener in the plating solution can be supplied neither too much nor too less even into the holes in the works.

Figure 7:
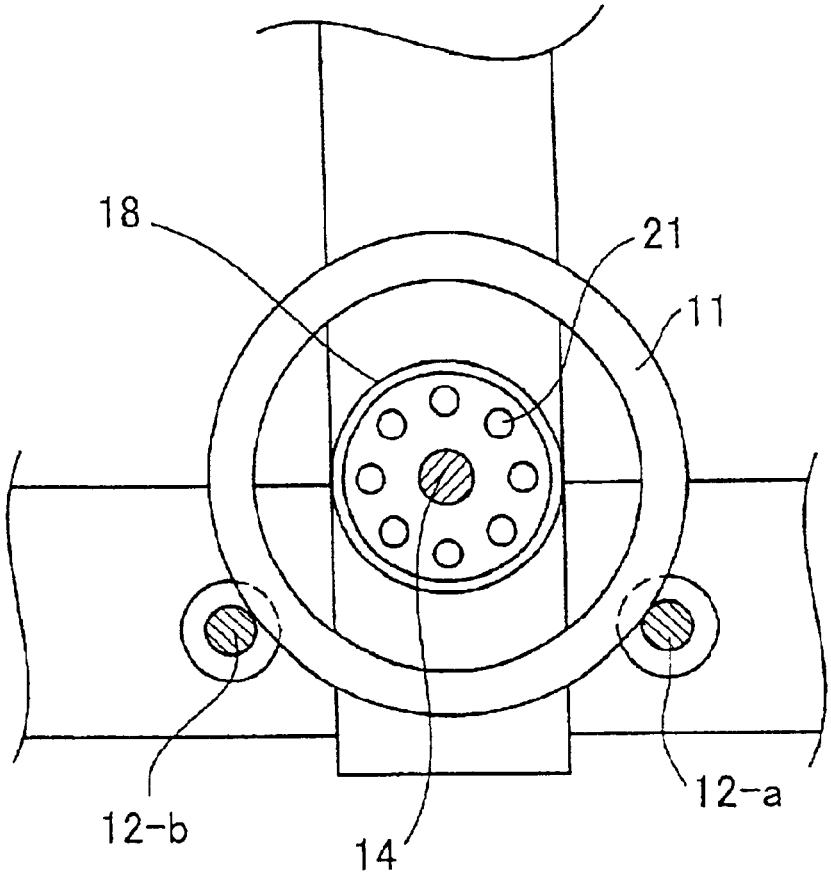
FIG. 7 is an enlarged view of an area near a discharge port 18 for a plating solution in the electroplating device, taken along a line B—B in FIG. 4.

FIG. 7 is an enlarged view of an area near the discharge port 18 for a plating solution in the electroplating device, taken along a line B—B in FIG. 4. The plating solution can be discharged vigorously by fitting a cap having a large number of fine bores 21 into the discharge port 18.

EXAMPLES

Example A

Six types of ring-shaped bonded magnets shown in Table 1 were produced and subjected to a test which will be described below.

TABLE 1

| | Outside diameter (mm) | Inside diameter D (mm) | Length L (mm) | L/D value |
|---|---|---|---|---|
| Magnet 1 | 22 | 20 | 2 | 0.1 |
| Magnet 2 | 22 | 20 | 4 | 0.2 |
| Magnet 3 | 22 | 20 | 10 | 0.5 |
| Magnet 4 | 22 | 20 | 15 | 0.75 |
| Magnet 5 | 22 | 20 | 20 | 1 |
| Magnet 6 | 22 | 20 | 40 | 2 |

Magnet Producing Process

An epoxy resin was added in an amount of 2% by weight to an alloy powder produced in a rapid solidification process and having an average particle size of 150 $\mu$m and a composition comprising 12% by atom of Nd, 77% by atom of Fe, 6% by atom of B and 5% by atom of Co, and they were kneaded together. The resulting material was subjected to a compression molding under a pressure of 686 N/mm$^2$ and then cured for 1 hour at 170° C., thereby producing fifty magnets. The 50 produced magnets and 10 kg of a fine Cu-power producing material comprising short columnar pieces (made by cutting a wire) each having a diameter of 1 mm and a length of 1 mm were thrown into a treating chamber in a vibrated-type barrel finishing machine having a volume of 3.5 liters, where they were subjected to a dry treatment for 3 hours under conditions of a vibration frequency of 70 Hz and a vibration amplitude of 3 mm, thereby producing magnets each having a film layer formed of a fine Cu powder on the entire surface thereof.

Test Process

Ten of the 50 magnets were set in the electroplating device including the mechanism shown in FIG. 4, so that the anode was located apparently on the center axes of the magnets. The adjacent magnets were disposed, so that they were spaced at a distance of 5 mm to 8 mm apart from each other using the spacer. The device was disposed within a plating bath, so that the directions of the rollers were parallel to the positive electrode plate. Then, the magnets were subjected to an Ni-electroplating treatment under conditions of a current density of 3.0 A/dm$^2$, a plating time of 50 minutes, a pH value of 4.0, and a bath temperature of 50° C., using a plating solution having a composition comprising 260 g/l of nickel sulfate, 40 g/l of nickel chloride, an appropriate amount of nickel carbonate (having a pH value adjusted) and 35 g/l of boric acid, in such a manner that the magnets were rotated in three rotations per minute by rotating the roller. The supplying of electric current to the positive electrode plate and the supplying of electric current to the anode were carried out with a ratio of 3:1 using two rectifiers. After the Ni-electroplating treatment, the thickness of the plated film formed on each of the 10 magnets was measured at 5 points selected, as desired, on each of the central portions of the outer and inner surfaces of each magnet (i.e., 50 points on the 10 magnets) by a fluorescence X-ray thickness-meter.

Results of the measurement for the 6 types of the magnets are shown in Table 2. As apparent from Table 2, a uniform plated film having less variability of thickness was formed on each of the outer and inner surfaces of every magnet. No traces of contact with the rollers were observed on the outer surface, and the plated film was extremely uniform in appearance.

TABLE 2

| | Thickness (μm) of plated film at central portion of outer surface of magnet | | | Thickness (μm) of plated film at central portion of inner surface of magnet | | |
|---|---|---|---|---|---|---|
| | Example A | Com. Ex. A-1 | Com. Ex. A-2 | Example A | Com. Ex. A-1 | Com. Ex. A-2 |
| Magnet 1 | 25 ± 2 | 25.5 ± 4.5 | 24 ± 1 | 20.5 ± 0.5 | 19.5 ± 2.5 | 20 ± 1 |
| Magnet 2 | 25.5 ± 1.5 | 25 ± 5 | 24 ± 2 | 20 ± 1 | 20 ± 3 | 16 ± 1 |
| Magnet 3 | 24 ± 1 | 25 ± 3 | 25 ± 1 | 19.5 ± 0.5 | 19.5 ± 3.5 | 8.5 ± 0.5 |
| Magnet 4 | 24.5 ± 1.5 | 24.5 ± 4.5 | 25 ± 2 | 20 ± 1 | 21 ± 2 | 4 ± 1 |
| Magnet 5 | 25 ± 2 | 27 ± 3 | 24.5 ± 1.5 | 20 ± 1 | 20.5 ± 2.5 | 2.5 ± 0.5 |
| Magnet 6 | 25 ± 1 | 23.5 ± 3.5 | 25.5 ± 1.5 | 19.5 ± 0.5 | 20 ± 3 | 1.5 ± 0.5 |

Com. Ex. = Comparative Example

Comparative Example A-1

The six types of the magnets were subjected to the Ni-electroplating treatment under the same conditions, except that the roller rotated in the Example A was not rotated. Then, the resulting magnets were subjected to the same measurement as in the Example A. Results of the measurement for the 6 types of the magnets are shown in Table 2. As apparent from Table 2, a large variability of thickness of the plated film was produced on both the outer and inner surfaces, due to the fact that the roller was not rotated. In addition, traces of contact with the roller were observed on the outer surface of each of the magnets.

Comparative Example A-2

The six types of the magnets were subjected to the Ni-electroplating treatment under the same conditions, except that the anode used in the Example A was removed. Then, the resulting magnets were subjected to the same measurement as in the Example A. Results of the measurement for the 6 types of the magnets are shown in Table 2. As apparent from Table 2, the thickness of the plated film at the central portion of the inner surface was smaller, as the L/D value of the magnet was larger, due to the removal of the anode.

Example B

An epoxy resin was added in an amount of 2% by weight to an alloy powder produced in a rapid solidification process and having an average particle size of 150 μm and a composition comprising 12% by atom of Nd, 77% by atom of Fe, 6% by atom of B and 5% by atom of Co, and they were kneaded together. The resulting material was subjected to a compression molding under a pressure of 686 N/mm$^2$ and then cured for 1 hour at 170° C., thereby producing fifty ring-shaped bonded magnets each having an outside diameter of 31 mm, an inside diameter of 29 mm and a length of 4 mm.

Twenty-five of the 50 magnets were set in the electroplating device including the mechanism shown in FIG. 4, so that the anode was located apparently on the center axes of the magnets. The adjacent magnets were disposed, so that they were spaced at a distance of 3 mm to 5 mm apart from each other using the spacer. The device was disposed within a plating bath, so that the directions of the rollers were parallel to the positive electrode plate. Then, the magnets were subjected to an Ni-electroplating treatment under conditions of a current density of 1.5 A/dm$^2$, a plating time of 100 minutes, a pH value of 4.0, and a bath temperature of 50° C., using a plating solution having a composition comprising 260 g/l of nickel sulfate, 40 g/l of nickel chloride, an appropriate amount of nickel carbonate (having a pH value adjusted) and 35 g/l of boric acid, in such a manner that the magnets were rotated in three rotations per minute by rotating the roller. The supplying of electric current to the positive electrode plate and the supplying of electric current to the anode were carried out with a ratio of 2:1 using two rectifiers. After the Ni-electroplating treatment, the thickness of the plated film formed on each of the 25 magnets was measured at 5 points selected, as desired, on each of the central portions of the outer and inner surfaces of each magnet (i.e., 125 points on the 25 magnets) by a fluorescence X-ray thickness-meter. As a result, the thickness of the plated film on the outer surface of each of the 25 magnets was 20 μm±1 μm, and the thickness of the plated film on the inner surface of each of the 25 magnets was 22 μm±1 μm.

The magnet produced in the above manner and having the Ni-plated film was mounted in a spindle motor, and the counter-electromotive force was measured under a condition of 1,800 rpm and as a result, an average value of 3.16 V was obtained.

Comparative Example B

The remaining twenty-five magnets produced in Example B were subjected to an Ni-electroplating treatment in a rack manner (a rack position was moved at an interval of every 15 minute, so that no contact trace was left on each of the magnets) under conditions of a current density of 1.5 A/dm$^2$, a plating time of 100 minutes, a pH value of 4.0, and a bath temperature of 50° C., using a plating solution having a composition comprising 260 g/l of nickel sulfate, 40 g/l of nickel chloride, an appropriate amount of nickel carbonate (having a pH value adjusted) and 35 g/l of boric acid. After the Ni-electroplating treatment, the thickness of the plated film formed on the outer and inner surfaces of each of the magnets was measured by a fluorescence X-ray thickness-meter. As a result, the average thickness of the plated films on the outer surfaces of the 25 magnets was 20 μm, and the average thickness of the plated films on the inner surfaces of the 25 magnets was 15 μm.

The magnet produced in the above manner and having the Ni-plated film was mounted in a spindle motor, and the counter-electromotive force was measured under a condition of 1,800 rpm and as a result, an average value of 3.11 V was obtained.

The motor characteristic of the spindle motor in Example B is excellent more than that of the spindle motor in Comparative Example B, and the reason was believed to be that the distance between the magnet and the stator was decreased, because a uniform magnetic layer was formed on the inner surface of the magnet having the Ni-plated film in Example B.

What is claimed is:

1. A process for electroplating a work having a hole communicating with the outside, using an electroplating device, comprising:

inserting an anode through and disposed in the hole provided in said work and communicating with the outside;

rotating said work about its center axis by a driving roller;

supplying a plating electric current to said work;

providing said driving roller with a spacer to set adjacent works to be spaced a distance apart from each other and treating simultaneously a plurality of said works set such that they are spaced a distance apart from each other by the spacer; and depositing a positive electrode plate outside the outer surface of said work, wherein said driving roller supplies the plating electric current to said work.

2. A process for electroplating a work according to claim 1, wherein said work having the hole communicating with the outside is a ring-shaped work.

3. A process for electroplating a work according to claim 2, wherein said ring-shaped work is a ring-shaped bonded magnet.

4. The process for electroplating a work according to claim 1, further including at least one follower roller in parallel with the driving roller and contacting said work during rotation.

5. A process for electroplating a work having a hole communicating with the outside, using an electroplating device, comprising:

inserting an anode through and disposed in the hole provided in said work and communicating with the outside;

rotating said work about its center axis by a driving roller, wherein at least one follower roller in parallel with the driving roller contacts said work during rotation;

supplying a plating electric current to said work;

providing at least one of said driving roller and said at least one follower roller with a spacer to set adjacent works to be spaced a distance apart from each other and treating simultaneously a plurality of said works set such that they are spaced a distance apart from each other by the spacer; and depositing a positive electrode plate outside the outer surface of said work, wherein said at least one follower roller supplies the plating electric current to said work.

6. A process for electroplating a work according to claim 5, wherein said work having the hole communicating with the outside is a ring-shaped work.

7. A process for electroplating a work according to claim 6, wherein said ring-shaped work is a ring-shaped bonded magnet.

8. The process for electroplating a work according to claim 5, wherein said driving roller is adapted to abut against an outer surface of said work to support said work during the rotating step, and wherein said follower roller is made of metal and is adapted to abut against the outer surface of said work to support said work.

9. A process for electroplating a work having a hole communicating with the outside, using an electroplating device, comprising: inserting an anode through and disposed in the hole provided in said work and communicating with the outside;

rotating said work about its center axis by a driving roller which is made of metal and adapted to abut against an outer surface of said work to support said work during rotation of said work;

providing a follower roller adapted to abut against the outer surface of said work to support said work during rotation of said work;

supplying a plating electric current to said work;

providing at least one of said driving roller and said follower roller with a spacer to set adjacent works to be spaced a distance apart from each other and treating simultaneously a plurality of said works set such that they are spaced a distance apart from each other by the spacer; and depositing a positive electrode plate outside the outer surface of said work, wherein said driving roller supplies the plating electric current to said work.

* * * * *